US005593095A

United States Patent [19]

Davis et al.

[11] Patent Number: 5,593,095

[45] Date of Patent: Jan. 14, 1997

[54] NOZZLES FOR FUEL INJECTIONS

[75] Inventors: Robert M. Davis, Maylands; Jorge M. P. da Silva, West Leederville, both of Australia

[73] Assignee: Orbital Engine Company (Australia) Pty. Limited, Balcatta, Australia

[21] Appl. No.: 402,399

[22] Filed: Mar. 10, 1995

Related U.S. Application Data

[63] Continuation of Ser. No. 194,306, Feb. 4, 1994, abandoned, which is a continuation of Ser. No. 768,841, filed as PCT/AU91/00027, Jan. 23, 1991, abandoned.

[30] Foreign Application Priority Data

Jan. 26, 1990 [AU] Australia ..... PJ8341

[51] Int. Cl.[6] ..... F02M 61/08; F02M 61/18; F02M 67/12; F02M 69/04

[52] U.S. Cl. ..... 239/584; 239/533.12

[58] Field of Search ..... 239/533.2–533.7, 239/533.9, 533.11, 533.12, 584

[56] References Cited

U.S. PATENT DOCUMENTS

| | | | |
|---|---|---|---|
| 4,394,970 | 7/1983 | Hofmann et al. | 239/533.7 |
| 4,408,722 | 10/1983 | Frelund | 239/453 |
| 4,523,719 | 6/1985 | Hofmann | 239/533.12 |
| 5,090,625 | 2/1992 | Davis | 239/533.12 |

FOREIGN PATENT DOCUMENTS

| | | | |
|---|---|---|---|
| 3737896A1 | 5/1989 | Germany . | |
| 2094398 | 9/1982 | United Kingdom | 239/533.12 |
| 2112455A | 7/1983 | United Kingdom . | |
| 2146068 | 4/1985 | United Kingdom . | |

*Primary Examiner*—Andres Kashnikow

*Attorney, Agent, or Firm*—Nikaido, Marmelstein, Murray & Oram LLP

[57] ABSTRACT

An internal combustion engine fuel injector having a selectively openable nozzle (10) through which fuel is delivered to a combustion chamber of the engine. The nozzle (10) comprises a port (12) having an internal annular surface (13) and a valve member (20) having an external annular surface co-axial with respect to the internal annular surface. The annular surfaces being shaped so that when the internal and external annular surfaces are in sealing contact closing the nozzle the maximum width (17) of the passage between the surfaces is not substantially more than 40 microns, preferably not more than 20 microns, in the direction normal to the surfaces.

13 Claims, 2 Drawing Sheets

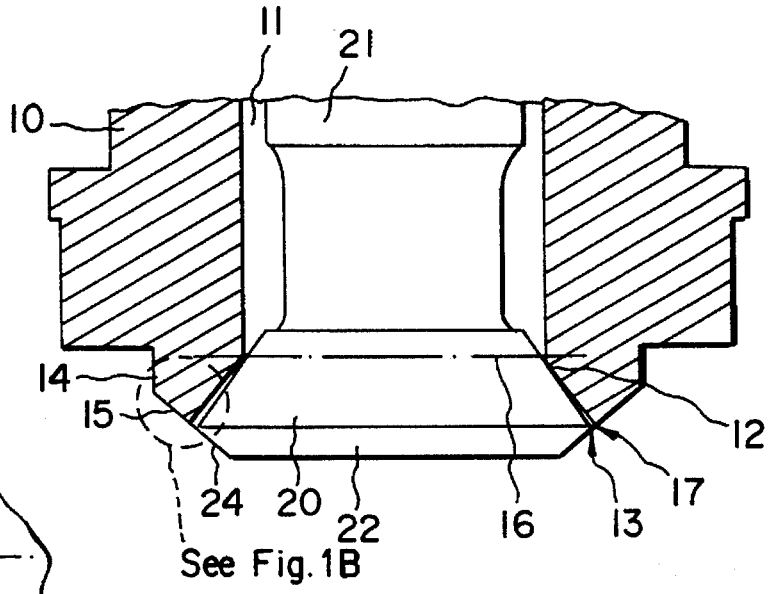
Fig. 1A
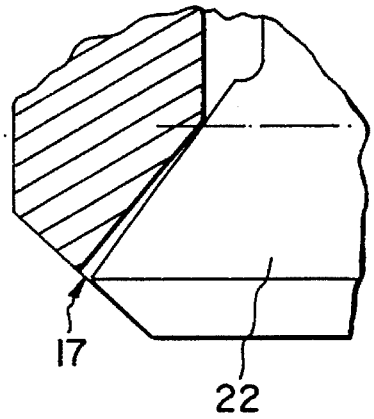
Fig. 1B
Fig. 2
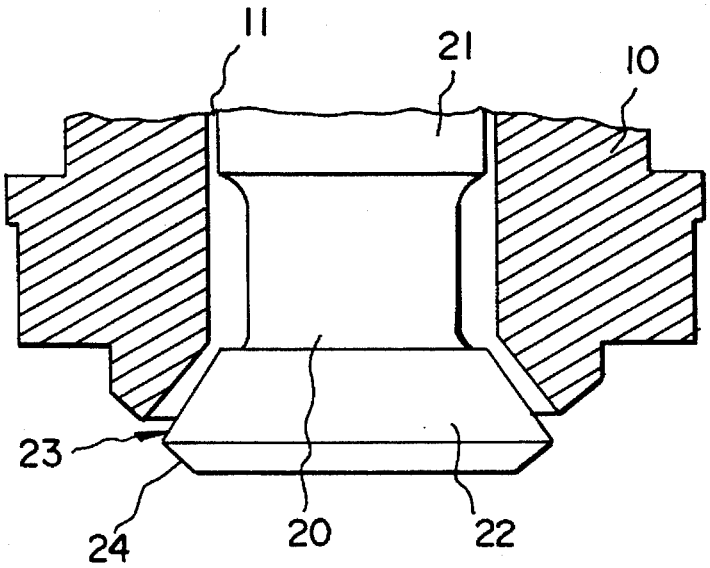

Fig. 3A
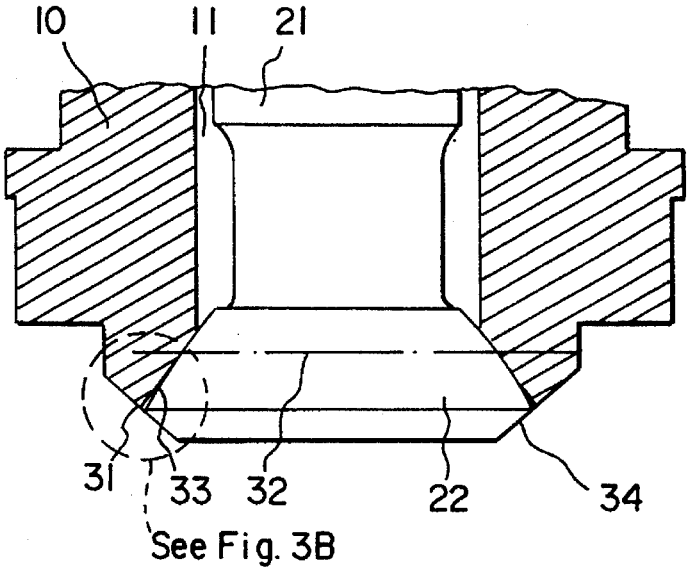
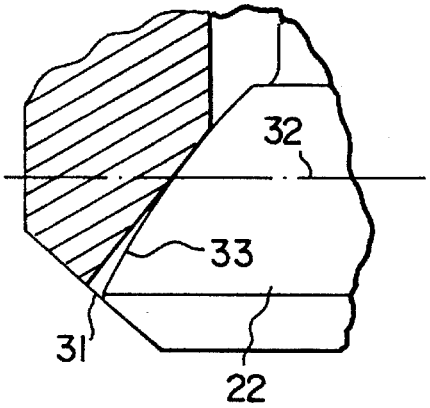
Fig. 3B
Fig. 4A
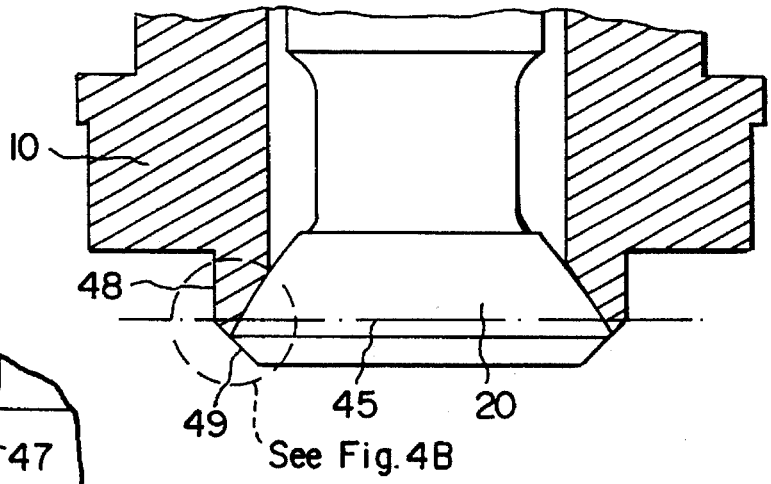
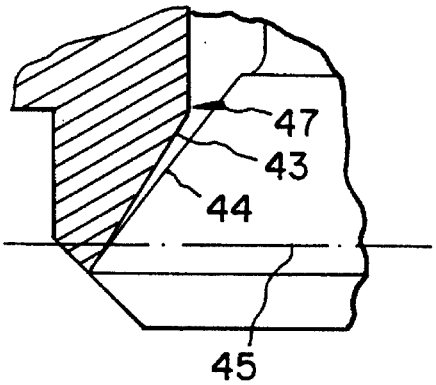
Fig. 4B

NOZZLES FOR FUEL INJECTIONS

This application is a continuation of application Ser. No. 08/194,306 filed Feb. 4, 1994 which is a continuation of application Ser. No. 07/768,841, filed as PCT/AU91/00027, Jan. 23, 1991, both now abandoned.

This invention relates to a valve controlled nozzle for the injection of fuel in an internal combustion engine. In this specification the term "internal combustion engine" is to be understood to be limited to engines having an intermitent combustion cycle, such as reciprocating or rotary engines, and does not include continuous combustion engines such as turbines.

The characteristics of the spray of fuel delivered from a nozzle to an internal combustion engine, such as directly into the combustion chamber, have a major affect on the efficiency of the burning of the fuel, which in turn affects the stability of the operation of the engine, the engine fuel efficiency and the composition of the engine exhaust gases. To optimise these effects, particularly in a spark ignited engine, the desirable characteristcs of the spray pattern of the fuel issuing from the nozzle include small fuel drop size (liquid fuels), controlled geometry and penetration of the fuel spray, and, at least at low engine loads, a relatively contained and evenly distributed ignitable cloud of fuel vapour in the vicinity of the engine spark plug.

Some known injection nozzles, used for the delivery of fuel directly into the combustion chamber of an engine, are of the poppet valve type, which delivers the fuel in the form of a cylindrical or divergent conical spray. The nature of the shape of the fuel spray is dependent on a number of factors including the geometry of the port and valve constituting the nozzle, especially the surfaces of the port and valve immediately adjacent the seat where the port and valve engage to seal when the nozzle is closed. Once a nozzle geometry has been selected to give the required performance, relatively minor departures from that geometry can significantly impair that performance.

In particular the attachment or build-up of solid combustion products or other deposits on the surfaces over which the fuel flows can be detrimental to the correct performance of the nozzle. The principal cause of build up on these surfaces is the adhesion thereto of carbon related or other particles that may be produced by the combustion or partial combustion of residual fuel left on these surfaces between injection cycles, or by carbon related particles produced in the combustion chamber during combustion.

The buildup of deposits on these surfaces can also adversely affect the metering performance of an injector nozzle where the metering of the fuel is carried out at the injector nozle. The existence of deposits can directly reduce the cross-sectional area of the fuel path through the nozzle when open, and/or cause eccentricity between the valve and the port of the nozzle thereby varying the cross-sectional area of the fuel path. The extent of these deposits can also be such that correct closing of the injector nozzle cannot be achieved and can thus lead to continuous leakage of fuel through the nozzle into the combustion chamber. This leakage would have severe adverse effects on the emission level in the exhaust gases, as well as instability in the engine operation.

It is therefore an object of the present invention to provide a nozzle, through which fuel is injected in an internal combustion engine, that will contribute to a reduction in the build up of deposits in the path of fuel being delivered to the engine, and hence improve the performance of the nozzle while in service.

With this object in view there is provided an internal combustion engine fuel injector having a selectively openable nozzle through which fuel is delivered to a combustion chamber of the engine, said nozzle comprising a port having an internal annular surface and a valve member having an external annular surface co-axial with respect to the internal annular surface, said valve element being axially movable relative to the port to selectively provide between said internal and external annular surfaces a continuous passage for the delivery of fuel therethrough or sealing contact therebetween along a circular seat line substantially co-axial to the respective annular surfaces to prevent the delivery of fuel therebetween, said annular surfaces being relatively configured so that when the internal and external annular surfaces are in sealing contact along said circular seat line the maximum width of the passage between the said surfaces to either side of the seat line is not substantially more than 40 microns in the direction normal to said surfaces.

Conveniently the maximum width of the passage is located downstream from the seat line with respect to the direction of flow of fuel through the passage.

The maximum width of the passage is preferably not substantially more than about 35 microns and preferably not substantially more than about 30 microns.

Preferably the body in which the port is formed and the valve member have respective terminal faces at the down stream end of the internal and external annular surfaces that are substantially normal to the respective annular surfaces. Preferably the terminal faces are substantially at right angles plus or minus 10° to the respective annular surfaces.

Conveniently the terminal faces of the body and valve member are substantially co-planar when the valve member is seated in sealing contact against the port along the circular seat line, or at least neither of the annular surfaces substantially overhang or extend beyond the extremity of the other at the down stream end, when the valve member is seated.

The length of at least one of the internal and external annular surfaces is preferably between about 0.50 and 2.0 mm and conveniently between 0.80 and 1.50 mm.

Conveniently the internal and external annular surfaces are inclined to the common axis thereof at respective angles so that they diverge from the circular seat line down stream in the direction of flow of the fuel during delivery.

The circular seat line can be located substantially at or adjacent the inner or smaller diameter end of the internal annular surface of the port.

The internal and external annular surface can conveniently be of truncated conical form, although the external annular surface of the valve member may be arcuate in axial section presenting a convex conveniently part spherical face to the internal annular surface of the port. The use of the convex face does assist in manufacture in obtaining the desired location of the circular seat line sealing between the port and valve member.

The above described relationship of the internal and external surfaces has been proved in testing to maintain the desired spray formation and desired performance of the nozzle over longer periods than previously achieved. It is suggested that the reduced maximum dimension of the gap between the annular surfaces downstream of the circular seat line may generate an impact load on any deposit each time the nozzle closes. This impact load dislodging the deposit and so preventing the build-up of deposits on the opposed surfaces.

Also the arranging of the terminal surfaces of the port and valve member substantially at right angles to the respective annular surfaces, results in any extension of deposits on the terminal surfaces into the path of the fuel being in the direct path of the fuel and so subject to the maximum impingment force from the fuel to break off such deposit extensions. The development of such overhanging deposits is also inhibited by the respective terminal facing being co-planar when the valve member is seated in the port.

The invention will be more readily understood from the following description of three practical arrangements of a fuel injector nozzle incorporating an embodiment of the present invention as illustrated in the accompanying drawings.

In the drawings:

FIGS. 1A and 1B are axial section views of a nozzle port and valve in the closed position with FIG. 1B being an enlargement of a portion of FIG. 1A;

FIG. 2 is a view as in FIG. 1A with the valve in the open position;

FIGS. 3A and 3B are views as in FIGS. 1A and 1B with an alternative valve configuration;

FIGS. 4A and 4B are views as in FIGS. 1A and 1B with a further alternative valve configuration;

Referring now to FIGS. 1A, 1B and 2, the nozzle body 10 has in the lower portion thereof an axial bore 11 therethrough terminating in a port 12, having an internal annular surface 13. Surrounding the port 12 is a projecting ring 14 having a terminal surface 15 which intersects the internal annular surface 13 at right angles.

The valve member 20 has a stem 21 with an integral valve head 22 at one end. The stem 21 co-operates with a suitable mechanism to axially reciprocate in the nozzle body 10 to selectively open and close the nozzle. Fuel, preferably entrained in a gas such as air, is supplied through the bore 11 to be delivered to an engine when the nozzle is open. The fuel may be metered as it is delivered through the nozzle or may be supplied in metered quantities to the bore 11.

The valve head 22 has an external annular surface 23, diverging outwardly from the stem 21, and a terminal face 24 converging from the extremity of the annular surface 23. The surfaces 23 and 24 are each of truncated conical form and intersect at right angles.

The cone angle of the annular surface 23 is less than that of the annular surface 13 so they diverge with respect to each other in the direction towards the terminal faces 15 and 24 respectively. The angles and diameters of the surfaces 13 and 23 are selected so that the valve head 22 is seated at the junction of the bore 11 and the internal annular surface 13 of the port 12. The circular seat line is indicated on the valve head 22 at 16. The length of the surfaces 13 and 23 are selected so that when the valve head, 22 is seated in the port 12, the respective terminal surfaces 15 and 24 are aligned. This can conveniently be achieved by grinding these surfaces after assembly of the valve member to the nozzle body.

The selection of the angles of the annular surfaces 13 and 23 and the length of each downstream of the seat line 16 determines the width of the annular gap 17 between them at the extremity thereof. In order to achieve the advantage of controlling the build up of deposits between these surfaces, the width of the annular gap 17, when the valve member 20 is seated, is not to be substantially more than 40 microns. This can also be achieved by grinding the terminal faces 15 and 24 after assembly.

In one practical form of the nozzle, the cone angles of the internal annular surface 13 and external annular surface 23 are 40° and 39° respectively, with the bore 11 nominally 4.20 mm diameter and the maximum diameter of the outer end of the valve head 22 nominally 5.90 mm. These dimensions result in the gap 17 being about 20 microns at the lower extremity, with the length of the internal surface 13 of the port being 1.35 mm.

It is to be understood that other nominal seat angles for the nozzle can be used and may be within the range of 20° to 60°, preferably in the range 30° to 50°. Also the length of the internal surface 13 of the port should not exceed 2.00 mm and is preferably between 0.8 and 1.5 mm.

In the alternative construction as shown in FIGS. 3A and 3B, the only variation from that shown in FIGS. 1 and 2 is that the external annular surface 33 of the valve head is not conical as in FIGS. 1 and 2, but is convex, conveniently arcuate, in cross-section. The contour of the convex annular surface is selected in relation to the internal annular surface 13 to locate the circular seat line 32 spaced from the junction of the bore 11 and internal surface 13, and so the gap between the internal and external surfaces 13 and 33 progressively increases from the seat line 32 to the terminal face 34. Again the width of the gap 31 at the terminal face 34 is of the order of 20 to 30 microns when the valve member is seated. The convex surface may be part of a sphere or a blend of two or more part-spherical surfaces, and is symmetrical with respect to the axis of the valve member 20. In a further modification, the internal annular surface of the port is concave and the external annular surface of the valve head is convex.

In a further embodiment of the invention, the annular surfaces of valve member 20 and port 10 are configured so that the seat line is adjacent the outer or downstream extremity of the internal annular surface of the port. This construction is shown in FIGS. 4A and 4B, wherein the internal annular surface 43 of the port 10 and external annular surface 44 of the valve member 10 are each of truncated conical shape. The cone angle of the external annular surface 44 is greater than that of the internal annular surface 43 so that the surface contact is at or adjacent the lower ends thereof along the seat line 45. Thus the passage between the surfaces 43 and 44 extend upstream from the seat line 45 to the location of maximum width 47. Again the internal and/or external annular surfaces may be convex or concave as above discussed.

Also in the embodiment shown in FIG. 4 the terminal face 48 of the port is substantially inclined to the terminal face 49 of the valve member. The configuration of the terminal faces may also be incorporated in the embodiment as shown in FIGS. 1 to 3 and likewise the configuration shown in FIGS. 1 to 3 may be incorporated in the embodiment shown in FIG. 4. The rearwardly inclined face 48 results in only a relatively small mass of metal at the tip of the body which will in use maintain a high temperature and therefore burn off any particles deposited thereon.

Each of the embodiments of the nozzle described have an outwardly opening valve member, commonly referred to as a poppet valve, however, the invention is equally applicable to inwardly opening valve members, commonly referred to as pintel valves.

The above described nozzle may be used in any form of fuel injector using a poppet type valve, and may be used for injecting either liquid or gaseous fuels, alone or in combination, and with or without entrainment in a gaseious carrier, such as compressed air.

The claims defining the invention are as follows:

1. An internal combustion engine fuel injector having a selectively openable nozzle through which fuel entrained in a gas is delivered directly to a combustion chamber of the engine, said nozzle comprising a port having an internal annular surface and a valve member having an external annular surface co-axial with respect to the internal annular surface, said valve member being axially movable relative to the port to selectively provide between said internal and external annular surfaces a continuous passage for the delivery of fuel entrained in gas therethrough or sealing contact therebetween along a circular seat line substantially co-axial to the respective annular surfaces to prevent the delivery of fuel entrained in gas therebetween, each said annular surface being of an openly divergent form in the direction of fuel delivery with said annular surfaces being relatively configured so that when the internal and external annular surfaces are in sealing contact along said circular seat line the maximum width of the passage between said surfaces downstream from said seat line is not substantially more than 30 microns.

2. A fuel injector as claimed in claim 1, wherein said valve member is axially movable outwardly with respect to the port to provide said continuous passage for the delivery of fuel.

3. A fuel injector as claimed in claim 1, wherein said maximum width of the passage is not more than about 20 microns.

4. A fuel injector as claimed in claim 1, wherein at least one of said annular surfaces has a length between about 0.50 and 2.00 mm.

5. A fuel injector as claimed in claim 1, wherein at least one of said annular surfaces has a length between about 0.80 and 1.50 mm.

6. A fuel injector as claimed in claim 1, wherein the internal and external annular surfaces are smoothly divergent downstream from the seat line.

7. A fuel injector as claimed in claim 1, wherein said internal and external annular surfaces are each divergent from the seat line and said maximum width of the passage therebetween is at the downstream end of said annular surface.

8. A fuel injector as claimed in claim 1, wherein at least one of the annular surfaces is of truncated conical shape.

9. A fuel injector as claimed in claim 1, wherein at least one of the annular surfaces is of part spherical shape co-axial to the other annular surface.

10. A fuel injector as claimed in claim 1, wherein the internal and external annular surfaces are of substantially the same length downstream of the seat line.

11. A fuel injector as claimed in claim 1, wherein at least one of the port or valve member has a terminal face at the downstream end of the annular surface thereof that is substantially normal to said annular surface.

12. A fuel injector as claimed in claim 1, wherein both the port and valve member have a terminal face at the downstream end of their respective annular surfaces, said terminal faces being substantially coplanar when the two annular surfaces are in contact along the seat line.

13. An internal combustion engine fuel injector having a selectively openable nozzle means for delivering fuel entrained in a gas directly to a combustion chamber of an engine, said nozzle comprising a port having an internal annular surface and a valve member having an external annular surface co-axial with respect to the internal annular surface, said valve member being axially movable relative to the port to selectively provide between said internal and external annular surfaces a continuous passage for the delivery of fuel entrained in gas therethrough or sealing contact therebetween along a circular seat line substantially co-axial to the respective annular surfaces to prevent the delivery of fuel entrained in gas therebetween, each said annular surface being of an openly divergent form in the direction of fuel delivery with said annular surfaces being relatively configured so that when the internal and external annular surfaces are in sealing contact along said circular seat line the maximum width of the passage between said surfaces downstream from said seat line is not substantially more than 30 microns.

* * * * *